US006759810B1

(12) United States Patent
Pan

(10) Patent No.: US 6,759,810 B1
(45) Date of Patent: Jul. 6, 2004

(54) TRANSMISSION STRUCTURE FOR ANIMATED ORNAMENTAL LIGHTINGS

(76) Inventor: Wen-Hua Pan, 7F, No. 285, Sec. 4, Chung-Hsiao E. Rd., Taipei City (TW)

( * ) Notice: Subject to any disclaimer, the term of this patent is extended or adjusted under 35 U.S.C. 154(b) by 0 days.

(21) Appl. No.: 10/325,893

(22) Filed: Dec. 23, 2002

(51) Int. Cl.[7] ..... H05B 37/00
(52) U.S. Cl. ..... 315/189; 362/806
(58) Field of Search ..... 315/189, 185 R, 315/192, 185 S; 362/806; 446/90, 91, 485

(56) References Cited

U.S. PATENT DOCUMENTS 3,689,758 A * 9/1972 Power ..... 362/104
5,020,409 A * 6/1991 Hou ..... 84/95.2
6,244,922 B1 * 6/2001 Kang ..... 446/149
6,312,308 B1 * 11/2001 Chen ..... 446/352

* cited by examiner

*Primary Examiner*—Wilson Lee
*Assistant Examiner*—Thuy Vinh Tran
(74) *Attorney, Agent, or Firm*—Birch, Stewart, Kolasch & Birch, LLP

(57) ABSTRACT

A transmission structure for animated ornamental lighting comprising an ornamental body, at least one transmission device mounted within said ornamental body, at least one illumination element mounted with the ornamental body 11; and at least one transmission structure connecting the transmission device to the ornamental body, whereby the transmission structure to transmit smooth motions to the ornamental body in order to adjust the moving direction, reducing or eliminating torque, causing high efficiency and extending the life-span of the transmission device.

8 Claims, 4 Drawing Sheets

TRANSMISSION STRUCTURE FOR ANIMATED ORNAMENTAL LIGHTINGS

FIELD OF INVENTION

The invention relates to a transmission structure, more particularly to a transmission structure having a spherical plain bearing that can reduce vibration and torque in order to provide smooth motions for the animated ornamental lightings.

BACKGROUND OF THE INVENTION

Nowadays it is a common practice to decorate sites of festivals and conventions with ornamental articles to foster joyful atmosphere. Ornamental lightings are indispensable articles for those events, especially for occasions such as flower lamps in Lantern festival, Christmas lights for Christmas, etc. In addition, in many parades, family parties and gatherings for celebrating special events, various types of ornamental lights are usually being used to augment the amusing and entertaining effect. Many people who care about quality of life also tend to decorate their living environment with some sorts of ornamental lightings in order to convey an atmosphere of joy and romance.

However, conventional ornamental lights are usually two-dimensional types with a lamp coupling to a fixed socket, they merely offer a two-dimensional and wall decorating effect, but cannot stand by themselves. Comparing with three-dimensional ornamental lights, they are less exciting and do not have lively effect.

While Conventional three-dimensional animal-shaped decorative lightings are comprised of an integrally fixed frame by which the lightings can be placed in standing position with support members, however, the facial expressions of these decorative lightings are always dull and stiff, which can only attract people's attention by an integrally fixed and beautiful frame on which different kinds and colors of shining light tubes or light bulbs are mounted. Since the conventional decorative lightings have been extant for a long time without particular variety, people are fed up with the lightings. Therefore, a new kind of decorative lighting that can execute the same motions as a real creature is needed. In respect to the above deficiencies, inventor of this invention is therefore invented an animated decorative lighting which can performs various motions of real creatures actuated by a simple transmission mechanism, however, there are still imperfections, notably:

1. The transmission mechanism of that invention merely used ordinary linkages having a anchoring hole at both ends, having one end mounted on the shaft of a motor and the other end mounted on the output members of different parts of the lighting; the position of the above anchoring hole on the shaft or the output members are fixed, thus the output members are force to move according to the motor, even there are positions that the output members cannot follow the rotation of the motor, it is also forced to follow, these kinds of force action will cause fretting and galling between the anchoring hole and the output members or the shaft, which eventually increase torque to the motor, reducing its efficiency and more seriously affect the normal life-span of the motor.
2. The above connection between linkage and output member, can merely transmit the rotating motions of the motor to plane motions, i.e. two-dimensional movement only, which is not animated and vivid enough, thus affecting the overall attraction of the lighting.

SUMMARY OF THE INVENTION

The principal object of the invention to overcome the above deficiencies by providing an improved transmission structure for animated ornamental lightings, which is using spherical plain bearings as the rod ends of a connecting linkage in order to produce various misalignment, so as to reduce fretting or galling between contact surfaces, thus reducing torque, increasing efficiency and the life-span of the motor.

It is a further object of the present invention to use spherical plain bearing as the transmission device for the animated ornamental lightings to produce more smoothly and vividly motions so that the lightings become more lively and attractive, thereby providing familiarity and curiosity to people, in order to differentiate from the conventional decorative lightings and has excellent commodity competitiveness.

To provide a further understanding of the invention, the following detailed description illustrates embodiments and examples of the invention, this detailed description being provided only for illustration of the invention.

DETAILED DESCRIPTION OF THE PREFERRED EMBODIMENTS

Figure 1A:
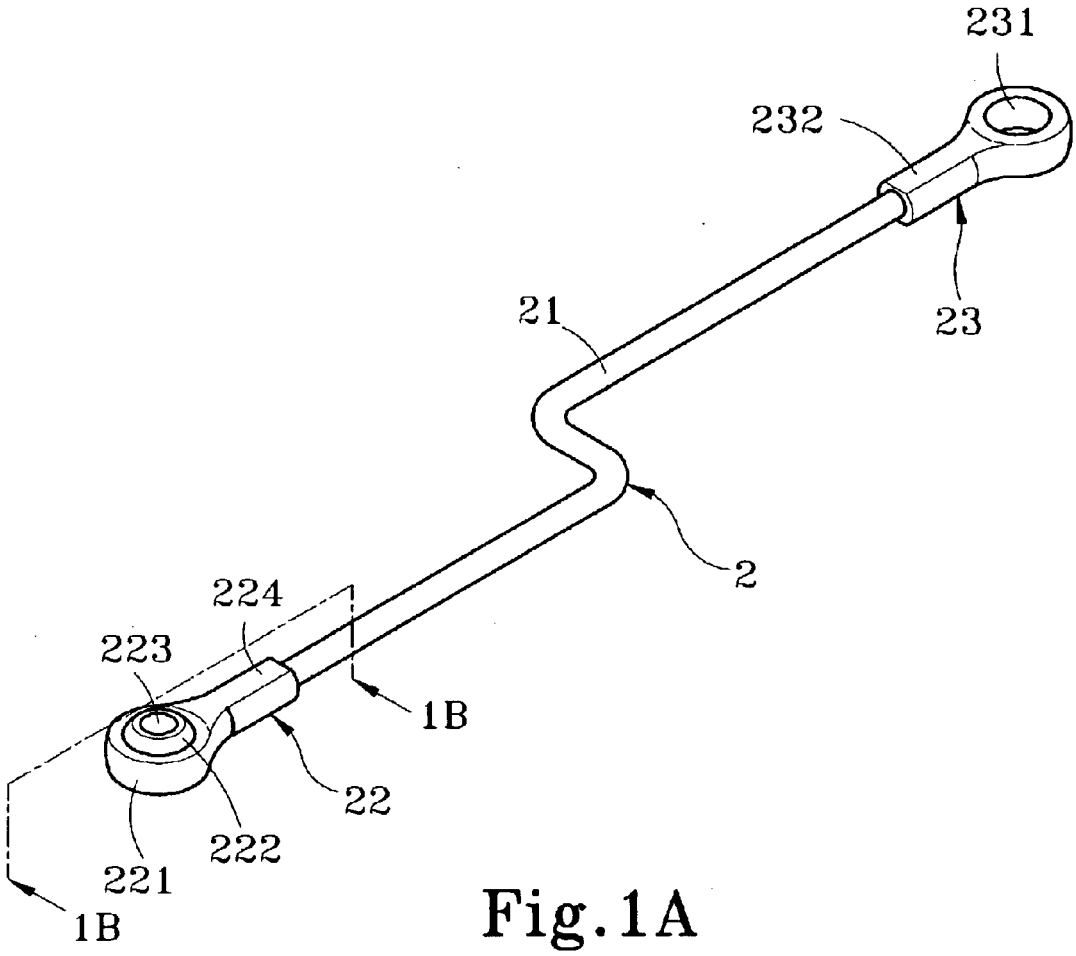
FIG. 1A is a schematic view of the present invention.
Figure 1B:
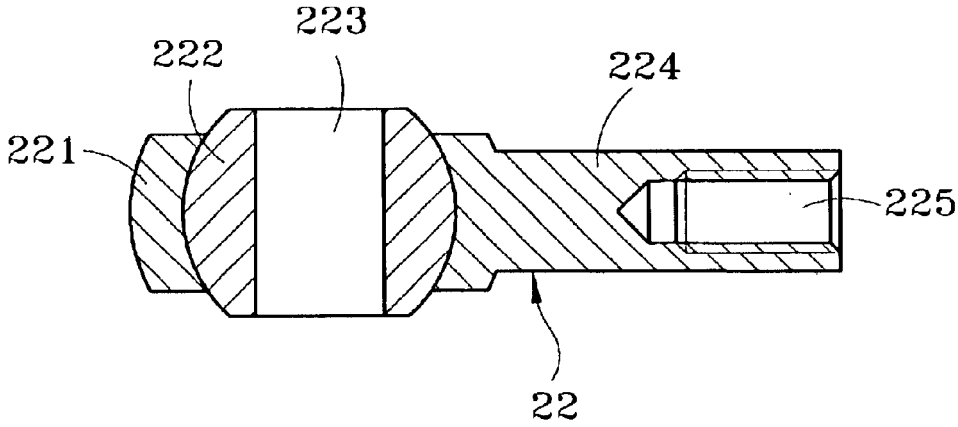
FIG. 1B is a sectional view of the present invention.
Figure 3:
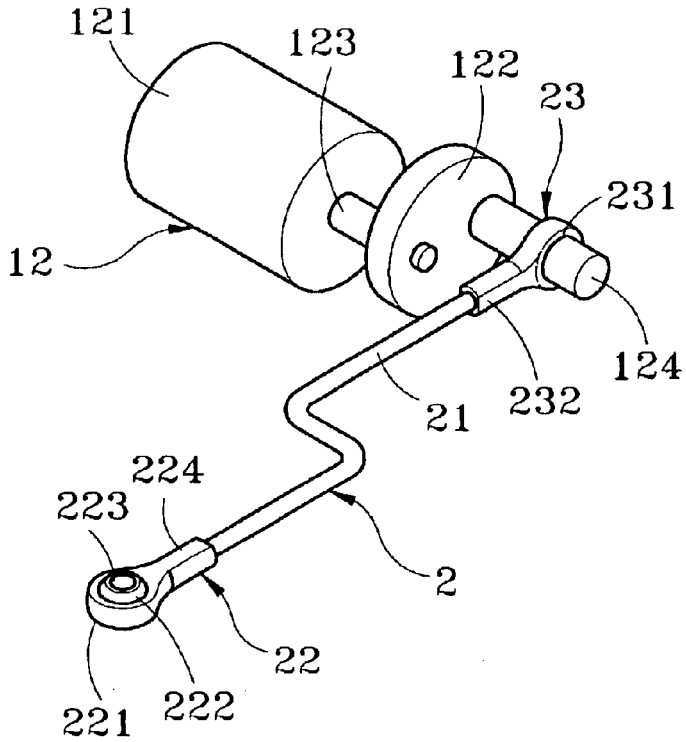
FIG. 3 is a perspective view of the present invention mounted on a transmission device.

Referring to FIGS. 1A, 1B and 3 which show a schematic view, a sectional view of the present invention and a perspective view of the present invention mounted on a transmission device, as shown by the figures, the present invention of a transmission structure 2 includes a rod 21 and a rod end 22,23, said rod end 22 further consists of an assembly portion 224 having an threaded hole 225 at one end used to screw to the rod 21, and a cylindrical housing 221 on the other end, to embrace a spherical plain bearing 222 (ball bushing) having a anchoring hole 223 therein; the other rod end 23 consists of an assembly portion 232 which is used to screw to the corresponding end of the rod 21, the assembly portion 232 is directly connected to a housing 231 in order to mount on an eccentric shaft 124 of the transmission structure 2; the spherical plain bearing 222 can accommodate the rod 21 with varying misalignment. The cylindrical housing 221 may have a liner of different material to minimize friction or to provide self-lubrication.

Figure 2:
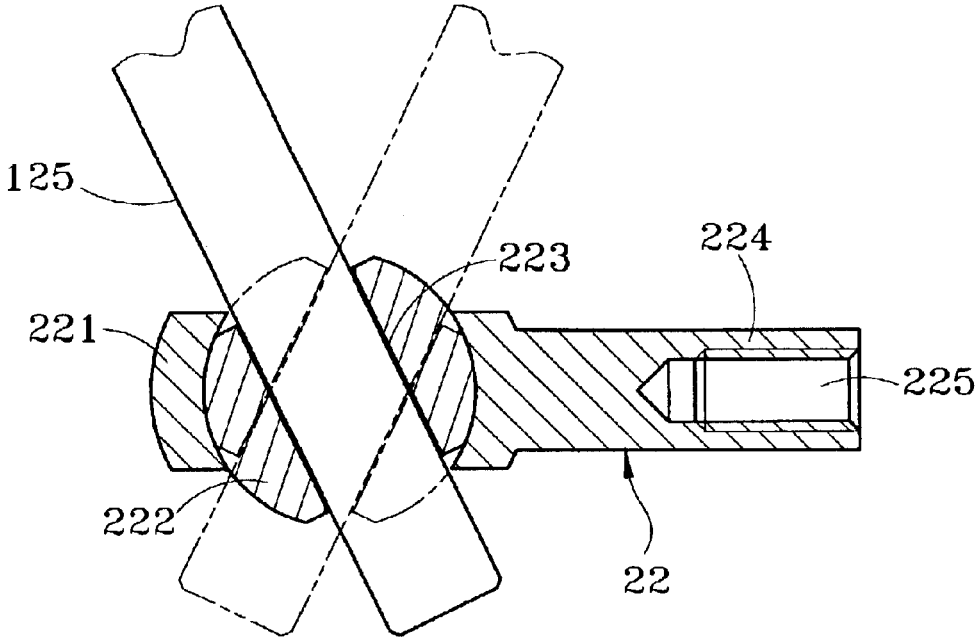
FIG. 2 is a view illustrating an operating state of the present invention.
Figure 4:
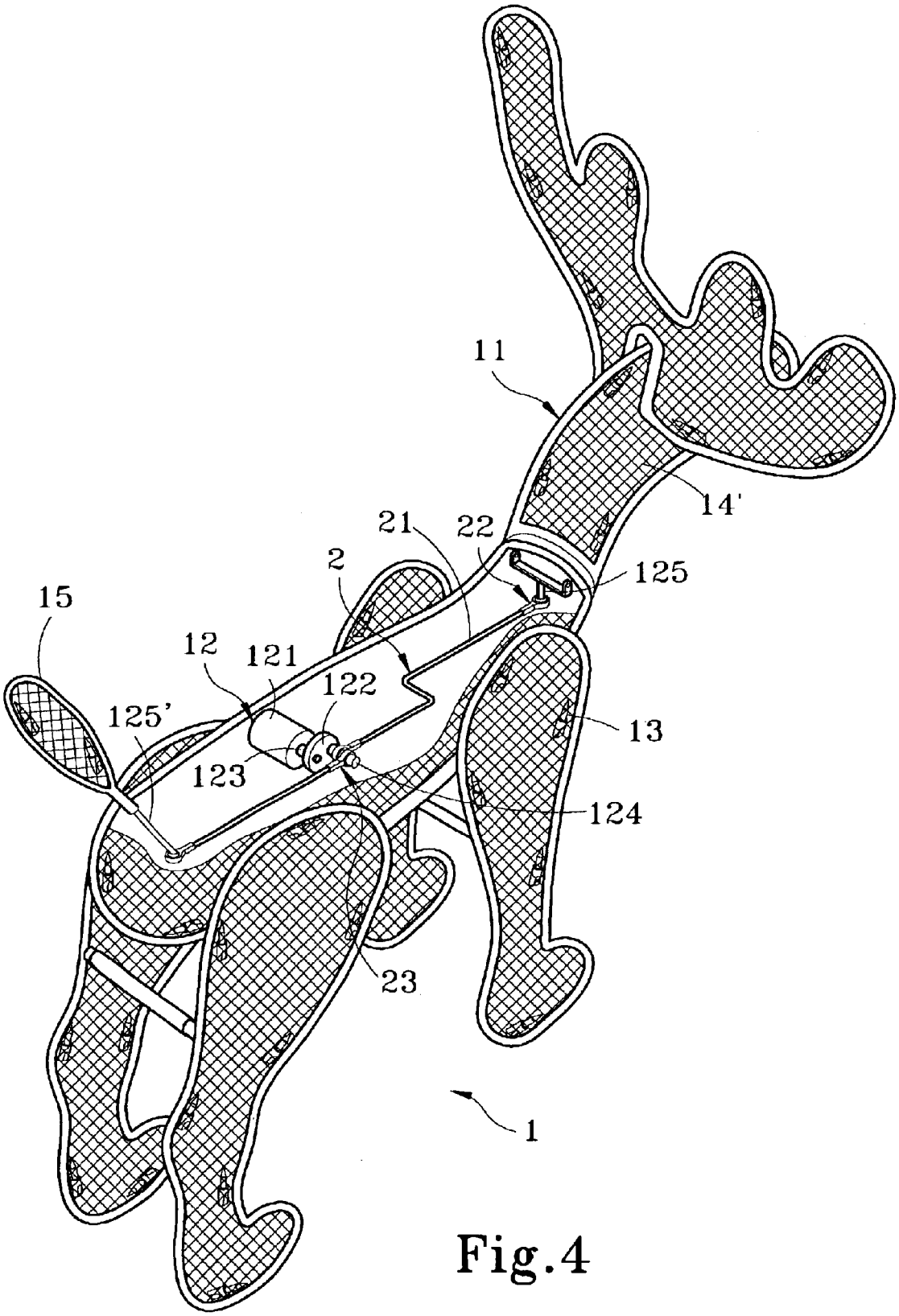
FIG. 4 is a view illustrating an operating state of the present invention within an animated ornamental lighting.

Referring to FIGS. 2, 3, 4 which shows a view illustrating an operating state of the present invention, a perspective view of the present invention mounted on a transmission device and a view illustrating an operating state of the present invention within an animated ornamental lighting, as shown by those figures, the present invention of transmission structure 2 is used to mounted on the transmission device 12 of an animated ornamental lighting 1, and such animated ornamental lighting 1 mainly includes. an ornamental body 11, at least one transmission device 12 and at least one illumination element 13 mounted therein.

The ornamental body 11 is made from a hot-melt resistant or high temperature resistant material and consists of auxiliary portions such as a head 14, a tail 15, those auxiliary portions are actuated by the transmission device 12.

The transmission device 12 includes a power device 121, an eccentric cam 122 connected to the above power device 122 by a reciprocal shaft 123, an eccentric shaft 124 connected the eccentric cam 122 to a plurality of transmission structures 2, such transmission structures 2 are used to connect the eccentric cam 122 to the output members 125 and 125' of auxiliary parts of said ornamental body 11.

The illumination element 13 may be a light bulb, light tubes or series of light bulbs.

The power device 121 is an electric motor. The power device 122 is mounted within said ornamental body 11 and supplies electrical energy to selectively rotate the eccentric cam 122 by a reciprocal shaft 123.

The eccentric cam 122 is connected to the transmission structure 2 by mounting the spherical plain bearing 222 to the eccentric shaft 124 of said eccentric cam 122, and the eccentric cam 122 can be variously shaped to provide a selected synchronize movement for each of the transmission structure 2 which are connected to auxiliary parts of said ornamental body 11. Naturally the shape of the cam determines the type of movement of the transmission structure 2.

The output members 125,125', each having one end connected to auxiliary portions of the ornamental body 11, and another end inserts into the anchoring hole 223 of the spherical plain bearing 222.

The operation of the present invention is described in detail as follows:

In case of head shaking of the ornamental body 11, the output member 125 is fixed on the head 14. When power is switched on, the illumination element 13 will be energized and start to twinkle and the power device 121 will start to rotate the eccentric cam 122 synchronously by a reciprocal shaft 123, and the rotation of the eccentric cam 122 actuates the transmission structure 2 which is mounted between the eccentric shaft 124 and the output member 125. When the eccentric cam 122 rotates continuously, the output member 125 will also start to vibrate, thus causing the head 8 to move upwardly and downwardly for providing a wobbling effect.

While wagging the tail 15 of the ornamental body 11, the transmission structure 2 is mounted on the tail 15. When the power device 121 rotates the eccentric cam 122, the output member 125' will be actuated to wave the tail 15, thus causing the tail 15 to move outwardly and inwardly in order to perform the swinging tail motion of a real deer.

Furthermore, when the head 14 and the tail 15 of ornamental body 11 are connected to the same eccentric shaft 124, thus, when the power device 121 provides energy to rotate the eccentric cam 122, the head 14 and tail 15 of the deer-shaped lighting 1 will move synchronously.

The advantages of using spherical plain bearing 222 as transmission structure 2 for animated ornamental lightings are described as follows:

1. The anchoring hole 223 of the spherical plain bearing 222 can accommodate rod 21 with varying misalignment (FIG. 2), thus the output member 125 can rotate spherically within the cylindrical housing 221, thus adjusting direction at any time, reducing or eliminating torque, causing high efficiency and extending the life-span of the power device 121 and the eccentric cam 122.
2. The use of thread and screw to connect between the rod 21 and the rod end 22, can further reduce and eliminate the rotational torque, and allow the rod 21 to adjust its directions and length in order to operate in coordination with the output members 125,125'.

Figure 5:
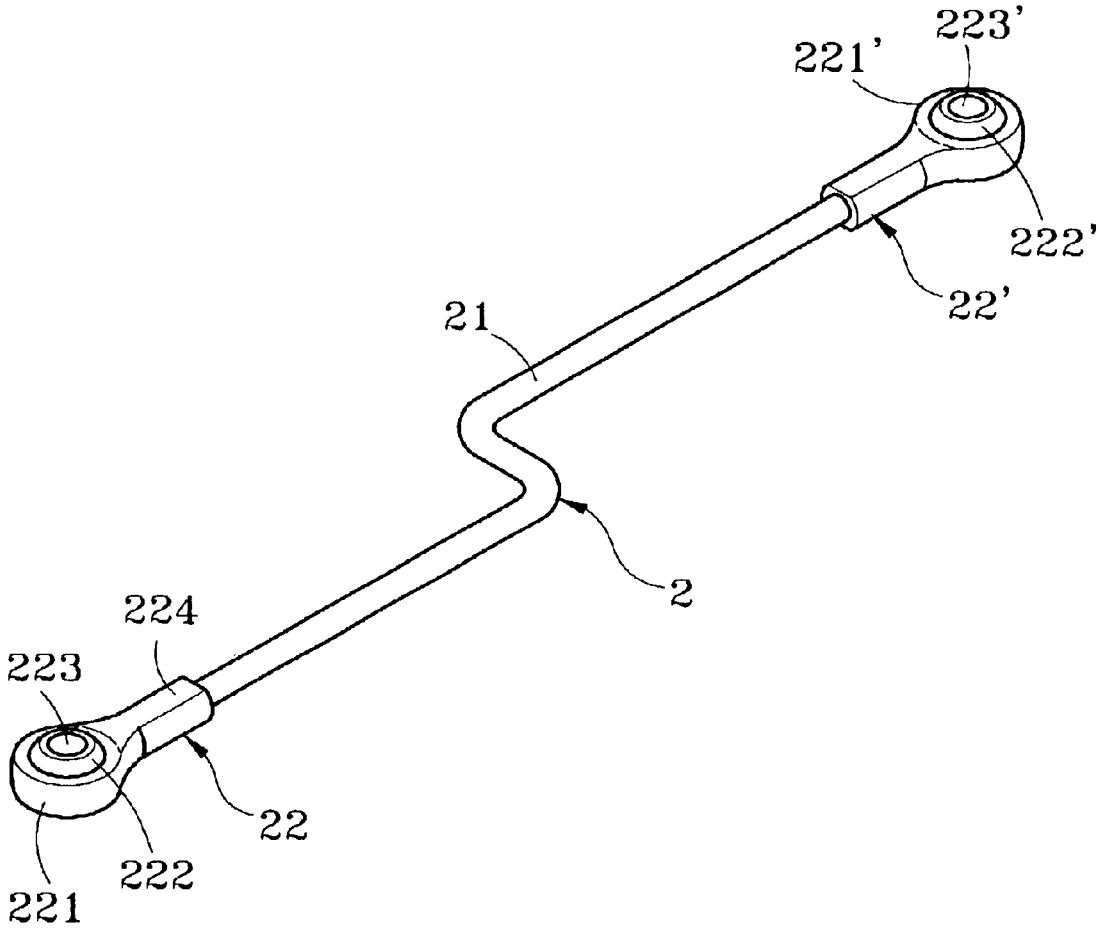
FIG. 5 is a view illustrating another example of the present invention.

Referring FIGS. 4 and 5, which are a view illustrating an operating state of the present invention within an animated ornamental lighting, and a view illustrating another example of the present invention, as shown by the figures, the invention of transmission structure 2 having both rod ends 22 mounted with a spherical plain bearing 222 respectively, can further accommodate the rod 21 with varying misalignment, thus the output member 125 and the eccentric shaft 124 can both rotate spherically within the two cylindrical housing 221, 221', thus adjusting directions at any time, reducing or eliminating torque, preventing fretting or galling of the contact surfaces between the eccentric shaft 124 and the inner surface of the spherical plain bearing 222 or the contact surface between the output member 125 and the spherical plain bearing 222' of the other end rod 22' when the output member 125 is inserted into the anchoring hole 223' of the rod 21, causing high efficiency and extending the life-span of the power device 121 and the eccentric cam 122.

Furthermore, the rod end 22 can be made of metal or plastic. During the manufacture of metal rod end 22, use latch to process the anchoring hole 223 and then insert a smaller size spherical plain bearing 222 into the anchoring hole 223, finally use punching to press again the cylindrical housing 221 in order to fix the position of the spherical plain bearing 222. While the plastic rod end 22 can be manufactured by plastic injection molding process.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A transmission structure for animated ornamental lighting comprising:

an ornamental body;

at least one transmission device mounted within said ornamental body;

at least one illumination element mounted with the ornamental body; and at least one transmission structure connecting the transmission device to the ornamental body;

the transmission structure being configured to transmit smooth motions to the ornamental body in order to adjust moving direction, reducing or eliminating torque, and extending life-span of the transmission device, the transmission structure includes a rod having at least two ends, at least one end of the rod has a spherical plain bearing inside a cylindrical housing.

2. The transmission structure for animated ornamental lighting of claim 1, wherein said rod having screws at both ends.

3. The transmission structure for animated ornamental lighting of claim 1, wherein said rod end having a threaded hole.

4. The transmission structure for animated ornamental lighting of claim 1, wherein said rod end is made of metal.

5. The transmission structure for animated ornamental lighting of claim 1, wherein said rod end is made of plastic.

6. The transmission structure for animated ornamental lighting of claim 1, wherein said both rod ends of the rod have a spherical plain bearing inside a cylindrical housing.

7. The transmission structure for animated ornamental lighting of claim 1, wherein only the at least one rod end of the rod has a spherical plain bearing inside a cylindrical housing.

8. The transmission structure for animated ornamental lighting of claim 7, wherein said cylindrical housing has a liner of materials to minimize friction or provide self-lubrication.

* * * * *